United States Patent [19]

Durenec

[11] 4,248,050

[45] Feb. 3, 1981

[54] DOUBLE-YOKE BALANCED COMPRESSOR

[75] Inventor: Peter Durenec, Annandale, Va.

[73] Assignee: The United States of America as represented by the Secretary of the Army, Washington, D.C.

[21] Appl. No.: 114,443

[22] Filed: Jan. 22, 1980

[51] Int. Cl.[3] ..... F25B 9/00

[52] U.S. Cl. ..... 62/6; 417/415

[58] Field of Search ..... 62/6; 417/415

[56] References Cited

U.S. PATENT DOCUMENTS

| | | | |
|---|---|---|---|
| 3,574,998 | 4/1971 | Bredow | 62/6 |
| 3,673,809 | 7/1972 | Bamberg | 62/6 |
| 4,092,829 | 6/1978 | Durenec | 62/6 |

*Primary Examiner*—Ronald C. Capossela

*Attorney, Agent, or Firm*—Nathan Edelberg; Milton W. Lee; Max L. Harwell

[57] ABSTRACT

A double-yoke balanced compressor for a cryogenic cooler that has only linear motion imparted to balanced piston and cylinder masses. A piston yoke is driven in the linear stroke direction by a piston axially offset crankshaft cam and a cylinder yoke is driven linearly by a cylinder axially offset crankshaft cam that is exactly offset 180° from the other cam. A large circular bushing in the compressor housing covers the entire outer cylinder head during linear operation to prevent blow by and to guide the cylinder linearly. The lower portion of the piston and cylinder connecting rods fit into linear guides that are further comprised of low molecular weight gas filled cavities to provide additional air bearing smoothness to the linear motion of the piston and cylinder.

15 Claims, 3 Drawing Figures

DOUBLE-YOKE BALANCED COMPRESSOR

The invention described herein may be manufactured, used, and licensed by the U.S. Government for governmental purposes without the payment of any royalties thereon.

CROSS-REFERENCE TO RELATED APPLICATION

The present invention is an improvement over applicant's prior art compressor in U.S. Pat. No. 4,092,829 entitled "Balanced Compressor" by the present inventor.

BACKGROUND OF THE INVENTION

1. Field of the Invention.

The present invention is in the field of balanced force compressors for cryogenic coolers and specifically for cryogenic coolers of the Stirling cycle or related types.

2. Description of the Prior Art

The latest cooling system used in electronic detection and surveillance systems having low temperature solid state devices thereon generally employ cryogenic coolers like the Stirling cycle devices, i.e. closed systems with compressors and regenerators. Problems have existed in previous cooler compressors in that there has been excessive wear in seals caused by lateral loads during the power strokes of the pistons and cylinders. These lateral loads and excessive seal wear cause intolerable vibration and noise in the cooler compressor system.

SUMMARY OF THE INVENTION

The present invention is comprised of an improved cryogenic cooler compressor and system in which lateral forces in the piston and cylinder are eliminated and the forces in the linear direction are balanced. The cooler compressor produces desired sinusoidal pressure waves by a double-yoke compressor comprised of piston and cylinder yokes driven by two axially offset crankshaft journals that are rotated by an electric motor enclosed in a closed cooling system compressor where the two axially offset crankshaft journals are offset exactly 180° from each other. The mass of the piston and its connecting rod and the piston yoke, herein called the total piston mass, and the mass of the cylinder and its connecting rod and the cylinder yoke, herein called the total cylinder mass, have equal masses and their stroke lengths are the same, thus providing the same average mass acceleration that balances the linear forces. The inner races of both the piston and the cylinder yokes are generally square shaped with slightly smaller distances between the two opposing faces in the linear direction than the two opposing faces in the lateral direction so that rotation of the two axially offset crankshaft journals impact forces only back and forth in the linear, or stroke, direction of the piston and cylinder.

There are piston and cylinder guide means at the cylinder head and piston ends of the piston and cylinder connecting rods and also air bearing and guide means at the opposite ends of the piston and cylinder connecting rods. The piston and cylinder guide means at said ends opposite the cylinder head and the piston is comprised of a piston connecting rod linear guide and a cylinder connecting rod linear guide built in a base plate portion of said compresso housing having air tight gas cavities therein which the ends of the connecting rods operate against. The gas cavities have conduit means with a charge valve thereon between said cavities wherein the cavities and the conduit means are first filled with a low molecular weight gas, such as helium, oxygen, nitrogen or hydrogen, and are then sealed air tight. The guide means is further comprised of a bushing cylinder guide built in the compressor housing against which the entire outer area of the cylinder head is enclosed and oscillates back and forth therein.

The entire inner volume of the cooler compressor housing is charged with a low molecular weight working fluid, such as helium, oxygen, or hydrogen. The inner volume is first charged through a purging valve set screw assembly in which when the system is charged to 190–200 pounds per square inch (psi) the set screw is threaded air tight to seal the working fluid therein at the elevated pressure. The working fluid pressure is raised preferably to 190–200 psi because the cooling system cold finger regenerator operates more efficiently at that average pressure.

The diametrically axially offset crankshaft cams, or journals, have roller bearings that continuously rotate around the journal as the journal moves around the inner races of the piston and cylinder yokes. The bearings will therefore last longer than the normal lifetime since the linear forces caused by the journals against the upper and lower linear faces of the inner races will not repeatedly act on the same surfaces but the linear forces on the bearings will be continuously changing and thus the long run wear on the bearings will be evenly distributed.

The purpose of the present invention is to provide a noise and vibration free cooler compressor. That purpose has been accomplished by the present balanced mass-acceleration characteristics of the dual-reciprocating compressor. The double-yoke cryogenic cooler is quieter and more efficient, since it can operate at higher speeds because the mass-acceleration products of the total piston mass and the total cylinder mass are balanced since both masses are equal and have equal stroke distances. There is less friction in the system due to the elimination of side motion by the guide means. The enclosed gas in the cavities provides an air bearing means that affords much smoother linear operation of the piston and cylinder. The roller bearings in each of the axially offset journals that rotate about the inner races of the yokes wear more evenly since they continuously shift linear force loads thereon and thus provide smooth transitions in the up and down linear directions that are made even smoother by the low molecular weight gas in the air cavities providing smoothing transition forces on the ends of the piston and cylinder connecting rods.

The present invention will be better understood in the detailed description hereinbelow with reference to the following Figures.

DETAILED DESCRIPTION OF THE PREFERRED EMBODIMENT

Figure 1:
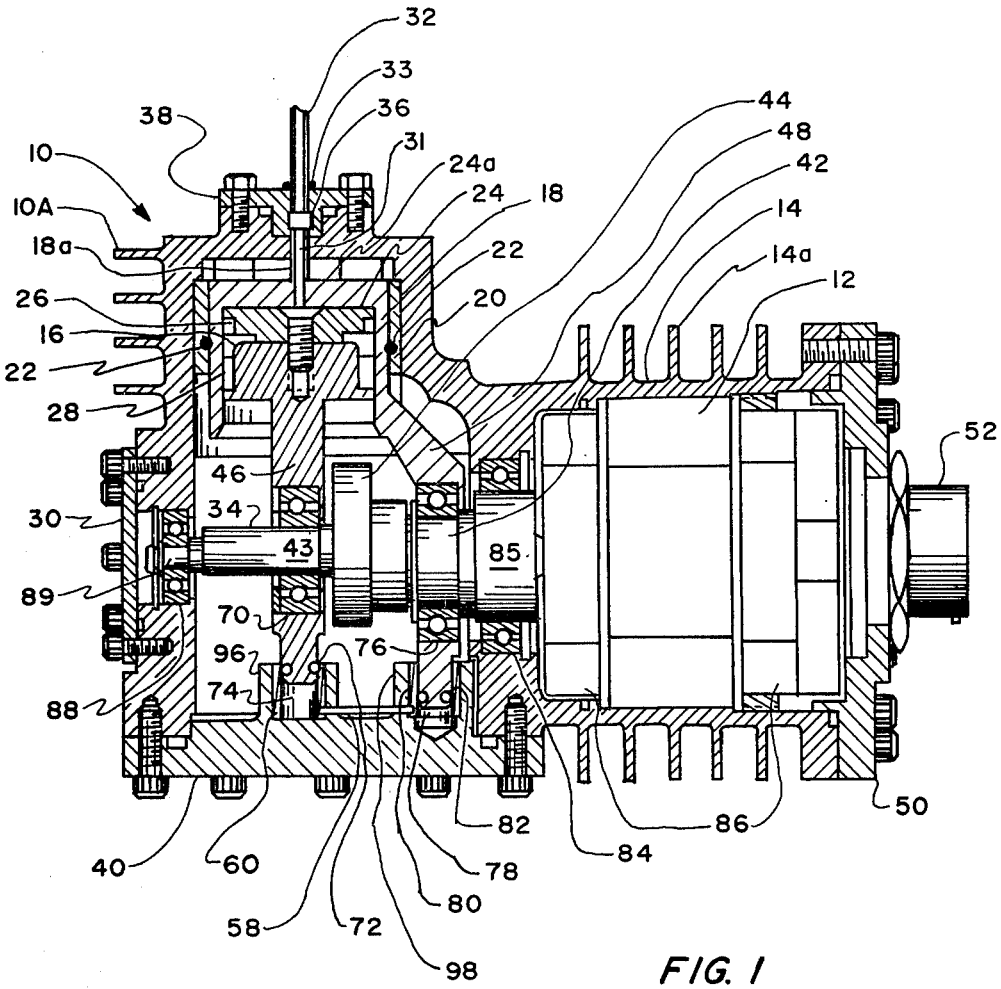
FIG. 1 shows a cutaway view of the present double-yoke cryogenic compressor.

Refer now to FIG. 1 for a more detailed description of the double-yoke balanced compressor cryogenic cooling system shown in cutaway view. The compressor housing is represented by numeral 10. Numeral 14 represents the electrical motor housing in which an electric motor 12 is housed. Motor 12 is preferably a direct current (DC) electric motor having electrical windings 86 instead of brushes since the low molecular weight working fluid enclosed within the compressor housing 10 and motor housing 14 would cause the brushes to deteriorate. The electrical leads from a power source (neither of which is shown) are connected to motor 12 through power lead connector 52. Connector 52 is an integral portion of back plate 50 and is screw threadably connected to motor housing 14. Housing 14 has cooling fins 14A thereon to dissipate heat. Motor 12 drives a crankshaft 34 which has a number of cams thereon with bearings surrounding the cam with the bearings either set in the housing 10 or riding against the piston, the cylinder, or the cold finger regenerator drives. Specifically, crankshaft cylindrical cams 85 and 89 ride on support bearings 84 and 88 respectively which may be built in the compressor housing. A compressor cover plate 30, at the end of the crankshaft 34 opposite the motor 12, is screw threadably connected to housing 10 by a plurality of screws. A base plate 40, having piston connecting rod linear guide 96 and cylinder connecting rod linear guide 98 therein, which will be elaborated on herein below, is screw threadably connected to housing 10 by a plurality of screws. A tubulation housing plate 38 is screw threadably connected to the compression housing 10 by a plurality of screws. All of the plates 30, 40, and 38 fit air tight against seals in housing 10 when secured to housing 10. Further, when working fluid tubing 32 is inserted through the tubulation housing plate 38 and into a tubing seal 36, a bead of sealant, such as solder and represented by numeral 33, is laid around plate 38 where tubing 32 enters housing 10.

Figure 3:
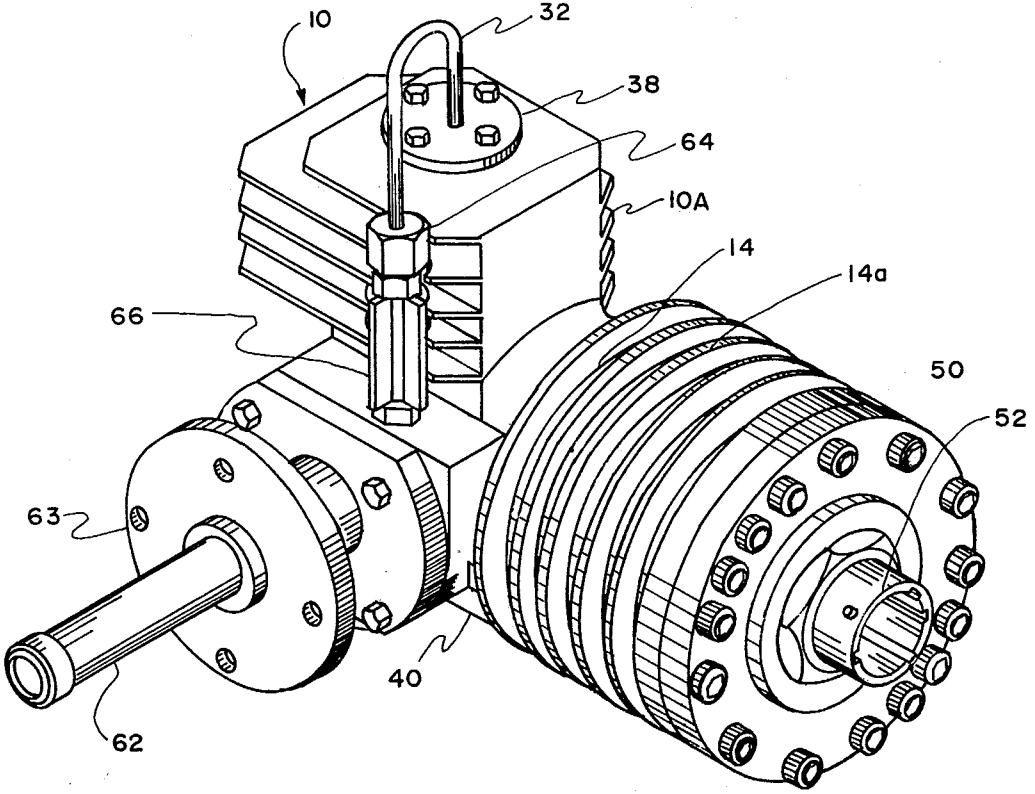
FIG. 3 shows a perspective view of the cryogenic compressor.

FIG. 3 illustrates a perspective outside view of the cryogenic compressor having many of the same numerically referenced items included as indicated above. It can be more easily seen how working fluid tubing 32 feeds out of the top of tubulation housing plate 38 to a cold finger 62 by way of a ferrule and nut assembly 64 for connecting tubing 32 to a tubulation adapter heat exchanger 66. Some of the heat caused by compression of the working fluid that is being transported by tubing 32 is dissipated by heat exchanger 66 prior to entering cold finger 62 to provide more efficient cooling cold finger. Numerical 63 represents the cold finger regenerator flange which is screw threadably connected to housing 10.

Figure 2:
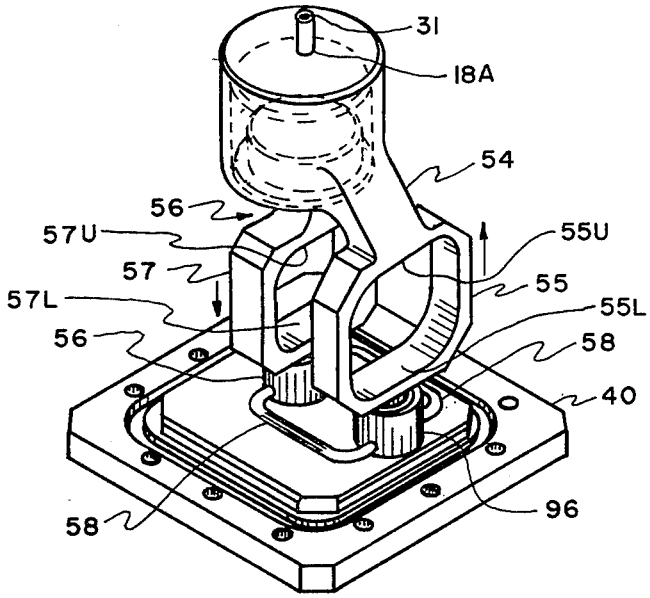
FIG. 2 illustrates the double-yoke piston and cylinder that are operated by a motor driven cam.

Refer to FIGS. 1 and 2 for further explanation of the present double-yoke balanced compressor that operates as a cryogenic cooler. It should be noted that the entire inner volume of the compressor housing is first charged with a low molecular weight working fluid, preferably helium but may be nitrogen, oxygen, hydrogen, etc, through a purging valve set screw assembly (not shown) in which the system is charged to about 190–200 psi and the set screw tightened to seal the working fluid therein. Cooling fins 10A and 14A are used to eliminate as much heat as possible from the compressor housing 10. A preferred speed of rotation that motor 12 drives the crankshaft 34 is from 1200–1500 revolutions per minute (rpms) which equates to 20 to 25 $H_z$ of the compression cycle from the compression chamber to the cold finger regenerator. The distance of the strokes for both the piston and cylinder are preferably 1/16 inch and in opposite directions from each other as will be explained more fully below. The compression chamber is defined as the volume between the piston face and the inner walls of the cylinder head 18. Pressure waves are transmitted out conduit 31 and working fluid tubing 32 to the cold finger 62. The piston face is further defined as the face of the piston seal retainer 24 which is screw threadably connected to the piston head 16. Retainer 24 has an ambient seal 26 therein that rides against the inner wall of the cylinder head. A circular bushing cylinder head guide 20, which is preferably made of brass, restricts the cylinder head 18 to linear motion only. Cylinder head guide 20 covers the entire outer portion of the cylinder head 18 sometime during the stroke of the cylinder and is thus very effective in eliminating lateral motion of the cylinder head 18 and piston 16. A low ambient temperature seal 22 in bushing 20 that moves back and forth on the outer portion of cylinder head 18 and the ambient temperaure seal 26 in the piston seal retainer 24 that moves back and forth on the inner portion of cylinder head 18 cooperate at various operating temperatures from ambient start-up to cryogenic temperatures to provide a continuously good seal between the piston, the cylinder head and compressor housing wall. Leakage at up to and slightly over 600 psi is sufficiently retarded at the high velocities of the piston 16 and the cylinder head 18.

The present dual reciprocating double-yoke cryogenic compressor may be fabricated with the compressor housing 10 and plates 30, 38, 40, and 50 made of aluminum alloys. The internal parts such as the crankshaft 32 and its various cams 89, 43, 44, 42, and 85, the piston 16 and its connecting rod 46, and the cylinder head 18 and its connecting rod 48 may be made of high strength steel. The support bearings 84 and 88, the piston connecting rod bearings 70, and the cylinder connecting rod bearings 76 may be made of powered metal or bronze. The various seals may be made of some resilient material, such as rubber.

In operation, crankshaft 34, riding on crankshaft cams 85 and 89 and bearings 84 and 88 respectively, rotates about the crankshaft axis. The crankshaft has at least two axially offset crankshaft cams that are preferably circular and have axes that are parallel to but offset from the crankshaft axis by a small amount, which is preferably 1/16 inch. Two of these axially offset crankshaft cams have diametrically axially offset cams exactly offset from each other by 180°. One of the diametrically axially offset cams is a cylinder axially offset crankshaft cam 42 which rides on cylinder connecting rod bearings 76 inside the race of a cylinder yoke 55. The other of the diametrically axially offset cams is a piston axially offset crankshaft cam 43 which rides on piston connecting rod bearings 70 inside the race of a piston yoke 57. Look now more closely at FIG. 2 along with FIG. 1 for further explanation of the crankshaft rotating diametrically axially offset crankshaft cylinder and piston cams 42 and 43 and their function with the total piston and cylinder masses respectively represented by numerals 56 and 54. For vibration free operation, masses 56 and 54 are exactly weight balanced with each other. Also, the stroke length of both the piston and cylinder are the same. The result is that the average mass acceleration product for both the piston 16 and its connecting rod 46 and the cylinder 18 and its connecting rod 48 are identical and whose products always cancel since their motion is always diametrically opposed. Numeral 57 represents the piston yoke having an inner race that is of generally square, with rounded corners to provide smooth cam and yoke interaction. Numeral 55 represents the cylinder yoke having an inner race that is also of generally square shape with rounded corners. The inner races are fabricated so that the square faces that are facing each other in the linear direction of the piston and cylinder stroke are less that the distance on equal amount to the diametrically axially offset cams, i.e. 1/16 inch, from the distance of the faces that are facing each other in the lateral direction. Forces on each of the piston and cylinder yokes 57 and 55 inner faces thus have forces only on face 57U representing the upper lines faces and 57L representing the lower linear face and clear the lateral faces, or sides, of the piston yoke 57 and face 55U representing the upper linear face and 55L representing the lower linear face and clear the lateral faces of the cylinder yoke 55. The piston axially offset crankshaft cam 43 and cylinder axially offset crankshaft cam 42 impart linear forces on the upper and lower linear faces of the piston yoke 57 inner race and the cylinder yoke 55 inner race from the rotational motion of the crankshaft 34. These linear forces are directly transmitted to the compression chamber and thus the cold finger regenerator as sinusoidal power strokes and pressure waves. The system also may have a direct cold finger regenerator crankshaft cam for directly driving the regenerator in the Stirling cycle mole. Since the regenerator represents a light load, balancing is rather simple even when the offset cam is in quadrature with the diametrically axially offset crankshaft cams.

The system has piston and cylinder air bearing and guide means for smoothing the linear motion of the piston and cylinder and to eliminate lateral motion of the piston and cylinder and their connecting rod masses. The guide means portion is actually comprised of two portions. One portion has been explained herein above and is comprised of bushing cylinder guide 20 against which the outer portion of the cylinder head 18 rides. The other guide means is further comprised of the air bearing means. The air bearing and guide means are comprised of a piston connecting rod linear guide 96 and a cylinder connecting rod linear guide 98 both having gas cavities therein where the ends of the piston connecting rod 46 and the cylinder connecting rod 48, which are opposite the piston and cylinder head, ride on a low molecular weight gas, such as helium, nitrogen or hydrogen, which is precharged in cavities 74 and 78 respectively. The low molecular weight gas is charged in cavities 74 and 78 through connecting tubing 58 which is common to both cavities and is then sealed off. Guides 96 and 98 respectively have piston connecting rod guide sleeve 60 and cylinder connecting rod guide sleeve 80 circling the interior thereof against which piston and cylinder connecting rod seals 72 and 82 move back and forth. Sleeves 60 and 80 are preferably made of hardened steel. Seals 72 and 82 may be made of Rulon or Teflon, and may be split circle or solid circle. The low molecular weight gas in cavities 74 and 78 provide smooth shifting pressures on the ends of the piston connecting rod 46 and the cylinder connecting rod 48 in opposite directions according to the diametrically opposing strokes imparted to the connecting rods by the diametrically axially offset crankshaft cams 42 and 43.

An upper end of cylinder head 18 has a reduced extension section 18A with a conduit pipe 31 built therein wherein the extension section 18A is axially aligned with the working fluid tubing 32 in a seal 36. Seal 36 allows the necessary movement of section 18A while remaining sealed with, as an example, an O-ring seal. With plate 38 having a sealant 33 around tubing 32 and plate 38 being threaded air tight to compressor housing 10, any leakage of the working fluid at tubing seal 36 will leak back into the charged system volume.

I claim:

1. In an improved closed cryogenic cooling system comprising an electric motor driven dual-reciprocating compressor which provides pressure waves of a low molecular weight working fluid to a cold finger regenerator; the improvement comprising:

a compressor housing;

a crankshaft driven by said electric motor and comprised of at least two axially offset crankshaft cams and at least two cylindrical support cams thereon wherein said at least two axially offset crankshaft cams is comprised of two diametrically axially offset crankshaft cams having axes parallel with the axis of said crankshaft and exactly offset 180° from each other with one of said diametrically axially offset crankshaft cams rotating in a piston yoke race of a piston and piston connecting rod mass for imparting linear motion to said piston and with a second of said diametrically axially offset crankshaft cams rotating in a cylinder yoke race of a cylinder and cylinder connecting rod mass for imparting linear motion of said cylinder in the opposite direction from the instantaneous direction of said piston, said piston and piston connecting rod mass and said cylinder and cylinder connecting rod mass having equal weights and equal stroke distances to provide the same average mass acceleration product resulting in balanced forces in the linear direction;

piston and cylinder air bearing and guide means for providing smooth linear motion and for eliminating lateral motion of said piston and piston connecting rod mass and said cylinder and cylinder connecting rod mass to prevent vibration and noise; and a conduit pipe and working fluid tubing in working cooperation between a compressor volume defined as the volume surrounded by the face of the piston and the surrounding inner walls of the cylinder and said cold finger generator in which said compressor housing surrounds said crankshaft, piston and cylinder, and piston and cylinder air bearing and guide means and the inner volume of said compressor housing is charged with said low molecular weight working fluid to an elevated pressure above atmospheric to provide a more efficient average pressure for said cyrogenic cooling system.

2. A system as set forth in claim 1 wherein said piston yoke race of said piston and piston connecting rod mass and said cylinder yoke race of said cylinder and cylinder connecting rod mass are generally square shaped with the distance between the faces in the linear piston and cylinder stroke direction being less than the distance between the faces in the lateral direction so that said diametrically axially offset crankshaft cams impart forces only on said piston and cylinder in the linear direction creating sinusoidal pressure waves in said compressor volume.

3. A system as set forth in claim 2 wherein said diametrically axially offset crankshaft cams are circular and have axes parallel to but offset from the axis of said crankshaft by 1/16 inch and wherein said piston and cylinder yoke races have faces in the linear stroke direction that are 1/16 inch less distance than the faces in the lateral direction and wherein the crankshaft speed of rotation is about 1500 revolutions per minute whereby said diametrically axially offset crankshaft cams impart a 1/16 inch stroke to said piston and cylinder yet do not touch the faces in the lateral direction.

4. A system as set forth in claim 3 wherein said elevated pressure to which the inner volume of said compressor housing is charged with said low molecular weight working fluid is from 190 to 200 pounds per square inch.

5. A system as set forth in claim 4 wherein said piston and cylinder air bearing and guide means is comprised of a bushing cylinder head guide in said compressor housing that surrounds the entire outer portion of said cylinder head and a piston connecting rod linear guide and a cylinder connecting rod linear guide with sleeves therein in working contact respectively against seals in said piston and cylinder connecting rods to form air tight piston and cylinder connecting rod linear cavities that are charged with a low molecular weight gas through a conduit means connecting said piston and cylinder cavities wherein the ends of said piston and cylinder connecting rods operate against said low molecular weight gas in opposite directions according to the diametrically opposing strokes imparted by said diametrically axially offset crankshaft cams.

6. A system as set forth in claim 5 wherein said diametrically axially offset crankshaft cams have roller bearings that continuously rotate and shift force loads evenly so that the bearings wear evenly.

7. A system as set forth in claim 6 wherein said at least two cylindrical support cams is comprised of two cylindrical support cams with one on each side of said diametrically axially offset cams and whose axes are the same as said crankshaft axis.

8. A system as set forth in claim 7 wherein said at least two axially offset crankshaft cams is further comprised of a cold finger regenerator crankshaft cam with the axially offset portion in quadrature with said diametrically axially offset crankshaft cams to operate said system in the Stirling cycle by directly driving said cold finger regenerator.

9. A system as set forth in claim 8 wherein said compressor housing is made of aluminum with said crankshaft, cams, piston and cylinder masses being made of hardened steel.

10. A system as set forth in claim 9 wherein said low molecular weight working fluid is helium.

11. A system as set forth in claim 10 wherein said low molecular weight gas in said air tight piston and cylinder connecting rod cavities is helium.

12. A system as set forth in claim 11 wherein said bushing cylinder head guide in said compressor housing is brass and has a low ambient temperature seal therein that rides against the outer portion of said cylinder head and wherein said piston has a piston seal retainer connected to the piston head with an ambient temperature seal therein that rides against the inner portion of said cylinder head whereby both low ambient and ambient temperature seals equally change sizes according to the operating temperature to provide equal sealing for said system.

13. A system as set forth in claim 12 wherein said sleeves in said piston connecting rod guide and said cylinder connecting rod guide are split ring.

14. A system as set forth in claim 13 wherein said sleeves are made of Rulon.

15. A system as set forth in claim 13 wherein said sleeves are made of Teflon.

* * * * *